United States Patent [19]

French

[11] Patent Number: 4,579,400

[45] Date of Patent: Apr. 1, 1986

[54] LOCKER CONSTRUCTION

[75] Inventor: Robert J. French, Wadsworth, Ohio

[73] Assignee: The Interior Steel Equipment Co., Cleveland, Ohio

[21] Appl. No.: 470,170

[22] Filed: Feb. 28, 1983

[51] Int. Cl.[4] ..... A47B 43/00

[52] U.S. Cl. ..... 312/257 SM; 312/257 R

[58] Field of Search ..... 312/257 R, 257 SK, 257 SM, 312/108; 292/DIG. 88, 76, 1

[56] References Cited

U.S. PATENT DOCUMENTS

| | | | |
|---|---|---|---|
| 1,132,598 | 3/1915 | Mershimer | 292/76 |
| 1,336,550 | 4/1920 | Buggeln | 292/1 |
| 1,384,880 | 7/1921 | Asher | 312/257 R |
| 1,833,882 | 11/1931 | Attwood | 312/257 R |
| 2,595,473 | 5/1952 | O'Conner | 312/257 SM |
| 2,991,140 | 7/1961 | Anderson et al. . | |
| 3,265,419 | 8/1966 | Durnbaugh et al. . | |
| 3,766,599 | 10/1973 | Ullman, Jr. . | |
| 3,819,246 | 6/1974 | List . | |
| 4,077,686 | 3/1978 | Bukaitz | 312/257 SM |
| 4,274,547 | 6/1981 | Takagi et al. . | |
| 4,296,982 | 10/1981 | Kullander . | |
| 4,426,935 | 1/1984 | Nikoden, Jr. | 312/257 SM |

FOREIGN PATENT DOCUMENTS

| | | | |
|---|---|---|---|
| 1009718 | 6/1948 | France | 312/262 |

OTHER PUBLICATIONS

Publication of The Interior Steel Equipment Co., entitled, "Locker Assembly Instructions".

*Primary Examiner*—William E. Lyddane
*Assistant Examiner*—Joseph Falk
*Attorney, Agent, or Firm*—Yount & Tarolli

[57] ABSTRACT

A locker whose basic enclosure, and also its frame, are essentially formed from five sheet metal members. The sheet metal members form the sides, back, top and bottom of the locker. Certain of the sheet metal members (particularly the side and top members) also have respective portions of the frame integrally formed therewith. The frame portions, when interconnected, form the support frame for the locker and also join the sides, back, top and bottom members together to complete the locker's enclosure. The frame portions also define part of the front side of the locker, and form a door opening in the locker. A locker door is pivotally movable relative to the door opening to control access to the locker's interior. The top and bottom sheet metal members are structurally identical to each other, so that only a single type of forming operation is required to form both sheet metal members. The locker also has several additional new and useful features, including (i) a unique handle and locking clip structure connected with the door and frame, (ii) a unique hinge structure which pivotally connects the locker door from the frame, and (iii) a unique spring latch for retaining the locker door in a closed condition.

14 Claims, 12 Drawing Figures

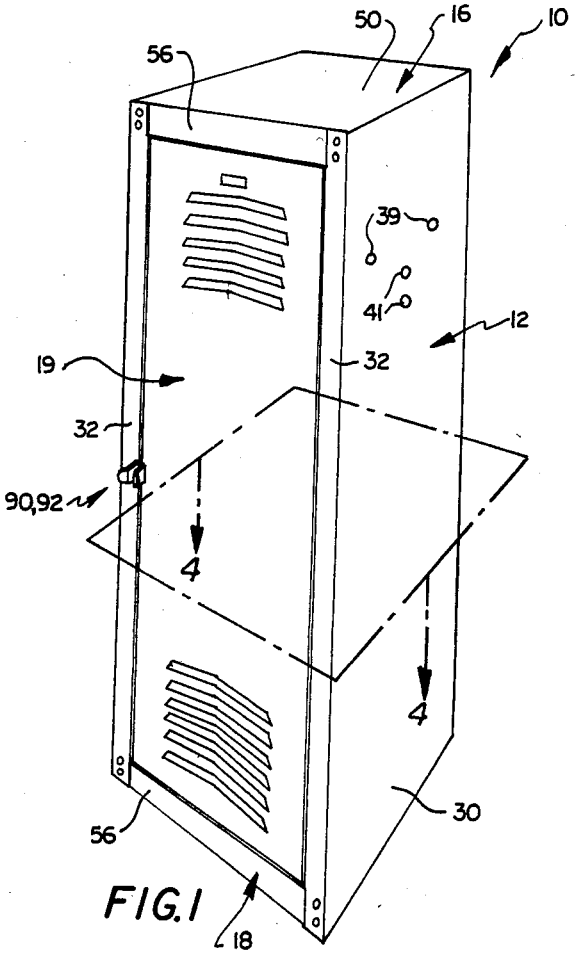
FIG.1
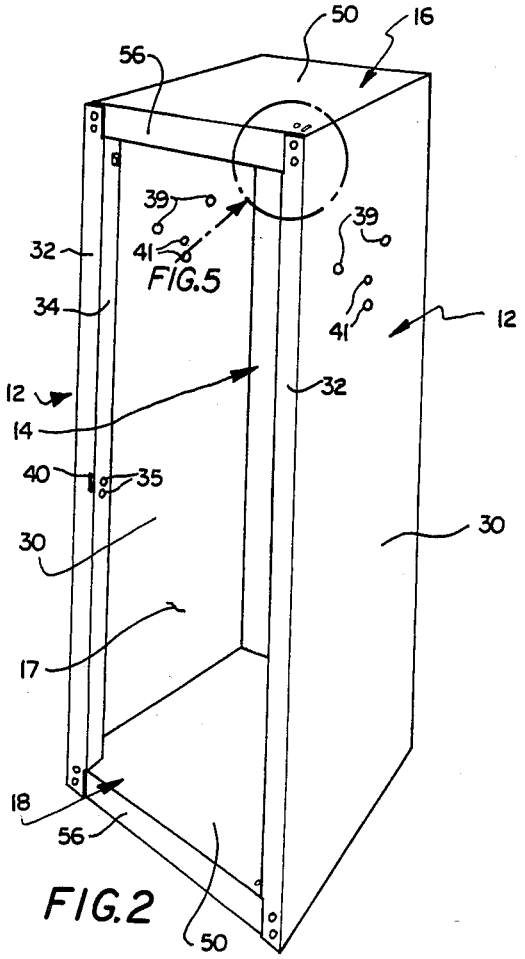
FIG.5
FIG.2
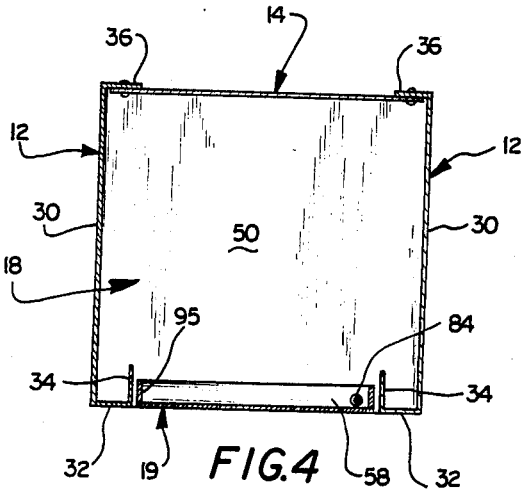
FIG.4
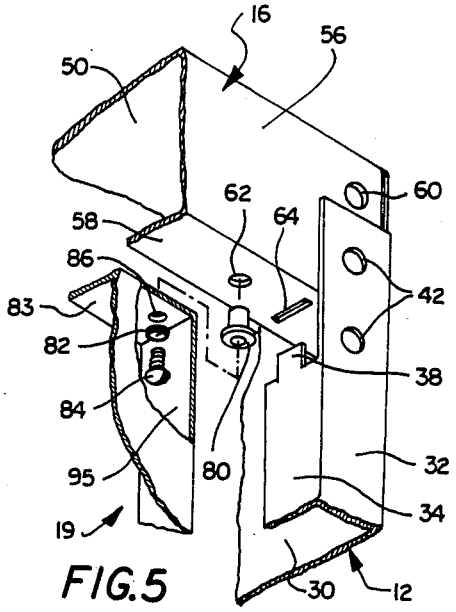
FIG.5

LOCKER CONSTRUCTION

BACKGROUND OF THE INVENTION

The present invention relates to a new and useful locker construction. It relates specifically to a locker formed by a relatively few number of integral sheet metal parts that form both the locker's frame and its basic enclosure. The sheet metal parts are simple and economical to manufacture, and are readily assemblable by the end user to complete the locker.

Lockers for storing clothing, articles of merchandise, etc., are typically formed by (i) a series of longitudinally extending metal frame members which are interconnected with each other to form the locker's frame, (ii) a separate series of planar sheet metal members which are secured to the frame (by bolting or welding) to complete the locker's basic enclosure, and (iii) a door pivotally mounted to the frame (typically by means of a butt hinge) for opening and closing access to the interior of the locker. The frame members provide the basic skeletal structure for the locker, and add strength and rigidity to the sheet metal members.

The components for constructing a locker are often shipped in partially assembled condition to the site where the locker is to be installed, and are there assembled and interconnected to form the locker. For example, with prior lockers that have been manufactured and sold by the assignee of this application, the components that are often shipped to the customer include (i) a door and frame subassembly including (a) a welded frame, (b) a door assembly that has been hinged to the frame and includes lock bar and handle components connected thereto, and (ii) the remaining body parts of the locker (e.g., sides, top, bottom, back). Whether those components are shipped in bulk, or in individual locker kits, the more components that are needed to form a locker, the more cumbersome the final assembly process. Moreover, in the applicant's experience, the more types of different components that must be constructed to form a locker, the higher the manufacturing costs.

SUMMARY OF THE INVENTION

This invention provides a locker construction which simplifies the number of parts that are used to form the locker, and which is believed to faciliate the manufacture as well as the assembly of the locker.

According to the invention, the locker's basic enclosure, and also its frame, are essentially formed from five sheet metal members. The sheet metal members form the sides, back, top and bottom of the locker. Certain of the sheet metal members (particularly the side and top members) also have respective portions of the frame integrally formed therewith. The frame portions, when interconnected, form the support frame for the locker and also join the sides, back, top and bottom members together to complete the locker's enclosure. The frame portions also define part of the front side of the locker, and form a door opening in the locker. A locker door is pivotally movable relative to the door opening to control access to the locker's interior.

In a locker according to the invention, a particular advantage is provided in the fact that the top and bottom sheet metal members are structurally identical to each other. Thus, only a single type of forming operation is required to form both sheet metal members. Moreover, the sheet metal side members are virtually identical, except for some holes that are punched in the side members. Thus, common tooling can be used for blanking both sheet metal side members.

A locker according to the preferred form of the invention also has several additional new and useful features, including (i) a unique handle and locking clip structure connected with the door and frame, (ii) a unique hinge structure which pivotally connects the locker door from the frame, and (iii) a unique spring latch for retaining the locker door in a closed condition.

BRIEF DESCRIPTION OF THE DRAWINGS

Further features of the invention will become further apparent from the following detailed description taken with reference to the accompanying drawings wherein:

FIG. 1 is a three dimensional view of a locker constructed according to the principles of the invention;

FIG. 2 is a three dimensional view of a locker constructed according to the invention, with the locker door removed;

FIG. 4 is a sectional view of the locker of FIG. 1, taken along the reference plane shown in phantom in FIG. 1, and looking in a downward direction, as shown by the arrows 4—4;

FIG. 5 is an exploded view of the area of the locker frame shown at 5—5 in FIG. 2, taken from the direction shown by the arrow in that Figure;

DETAILED DESCRIPTION OF THE PREFERRED EMBODIMENT

Figure 6:
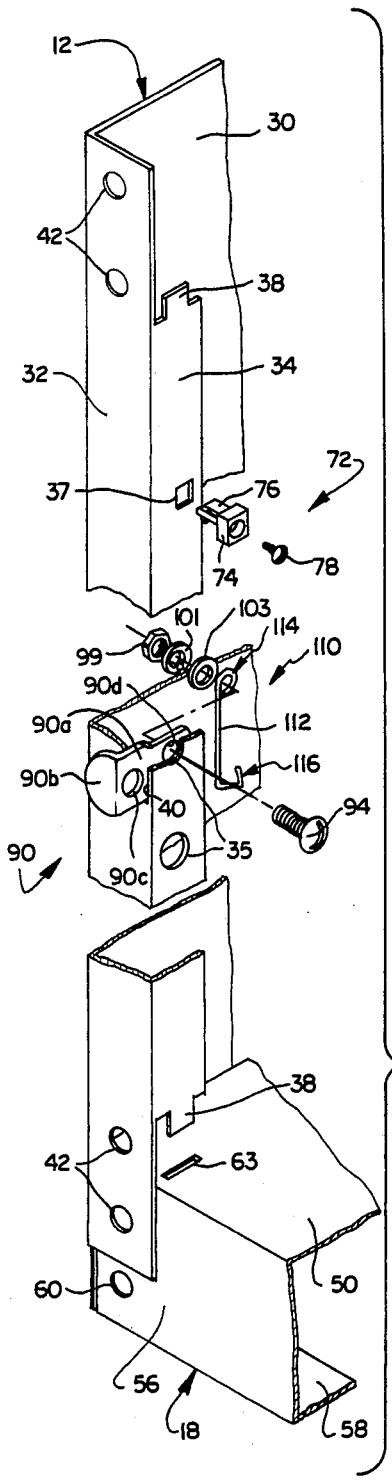
FIG. 6 is an exploded, three dimensional, fragmentary view taken along one vertical side of the door opening of the locker.

As discussed above, the present invention relates to a locker in which a series of sheet metal members have frame portions integral therewith. In this application, where a frame portion is referred to as "integral" with a sheet metal member, the term "integral" is intended to mean that the sheet metal member and the frame portion are a monolithic metal structure, and the frame portion is bent, stamped or otherwise formed out of the sheet metal member, and is not connected to the sheet metal member by some external means (e.g., bolts, welds, etc.).

In FIG. 1, a vertically extending locker, constructed according to the invention, is shown at 10. The sheet metal members comprise a pair of vertically extending side members 12, a vertically extending back member 14, and horizontally extending top and bottom members 16 and 18, respectively. Certain of the sheet metal members have integral frame portions that form part of the front side of the locker and define a door opening 17 in the front side of the locker (see FIG. 2). A door 19 is mounted for pivotal movement between open and closed positions relative to the door opening 17 to control access to the inside of the locker.

Referring to FIGS. 3–6, each of the sheet metal side members 12 has a planar, generally rectangular, vertically extending main body portion 30. At the front of the locker, each sheet metal side member 12 has an integral, vertical frame portion which includes (i) a proximal frame portion 32 which extends perpendicular to the plane of the main body portion 30, and (ii) a distal frame portion 34 which extends away from the proximal portion 32 and toward the back of the locker. The distal frame portion 34 is disposed in a plane that is parallel to the plane of the main body portion 30. As seen particularly from FIG. 6, the distal frame portion 34 of each side member extends longitudinally along the front edge of the main body portion 30, but terminates short of the top and bottom ends of the main body portion 30. Also, the distal frame portion 34 has tenons 38 at both of its longitudinal ends.

In the side member 12 disposed on one side of the door (i.e., the side member shown in FIG. 6) the distal frame portion 34 has a pair of spaced apart openings 35 about midway between its longitudinal ends. Furthermore, the distal frame portion 34 of that side member has a square opening 37 near its top end, for receiving a door stop member 72.

Figure 3:
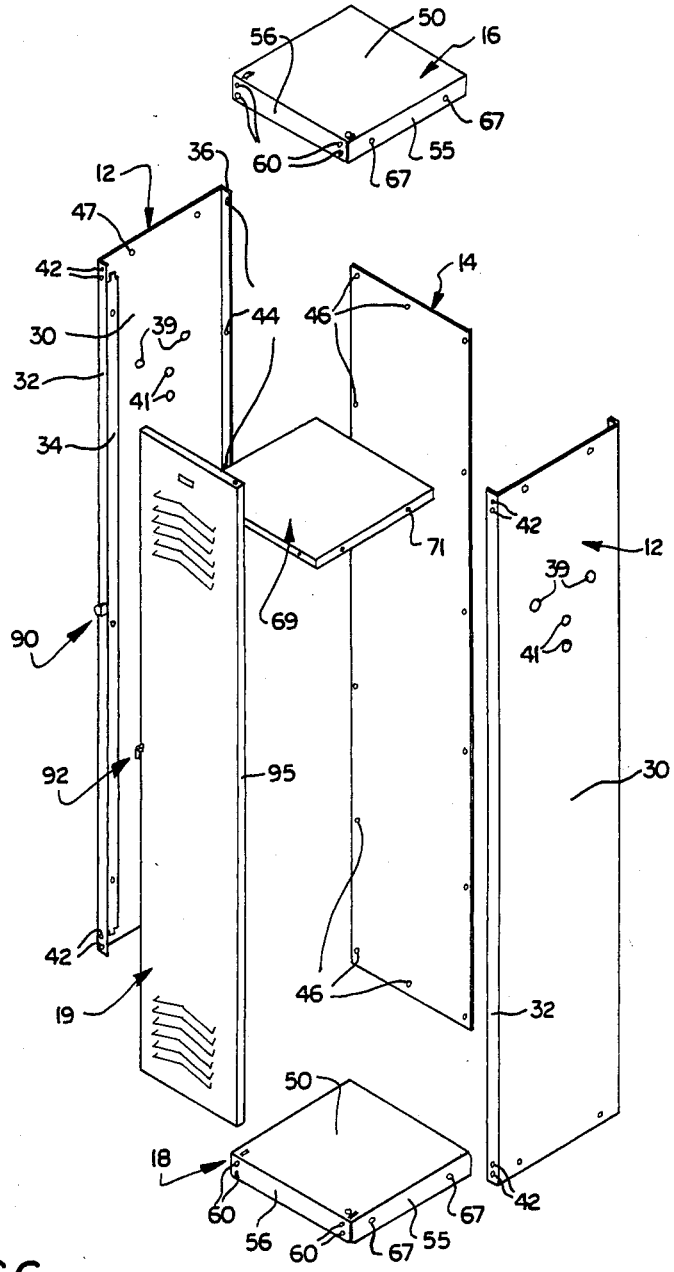
FIG. 3 is an exploded, three dimensional view of the principal components of the locker of the invention.

The proximal frame portion 32 of the sheet metal side member 12 shown in FIG. 6 has a rectangular opening 40 disposed between its longitudinal ends (see also FIG. 2). Additionally, the proximal frame portion 32 of each of the sheet metal side members 12 has a pair of bolt holes 42 near its top end and another pair of bolt holes 42 near its bottom end (FIGS. 3, 5 and 6).

At the rear of the locker, each sheet metal side member 12 has an integral, vertical, rear frame portion 36 that extends along the entire vertical length of the main body portion 30 in a plane that is perpendicular to the plane of the main body portion 30. The vertical rear frame portion 36 has a series of bolt holes 44 (FIG. 3) that are spaced apart and extend from the top to the bottom of the vertical rear frame portion.

Finally, the main body portion 30 of each sheet metal side member 12 has bolt holes that are used in securing shelves and hooks to the locker. In the illustrated example, the main body portion 30 of each sheet metal side member 12 has a pair of horizontally spaced bolt holes 39 for securing a shelf to the locker, and a pair of vertically spaced bolt holes 41 for securing a hook to the locker.

The sheet metal back member 14 comprises a rectangular, planar sheet metal member with a plurality of bolt holes 46 disposed about its periphery. The bolt holes 46 that extent vertically along the back member 14 are disposed so as to align with the bolt holes 44 in the vertical rear frame portions 36 of the sheet metal side members 12. The bolt holes 46 that extend horizontally along the back member 14 are disposed so as to align with bolt holes 67 in the top and bottom members 16, 18, as explained further hereinafter.

The horizontal top and bottom sheet metal members 16, 18 are structurally identical to each other. Each of the top and bottom members includes a planar, horizontal main body portion 50. Along the sides and the back of the locker, each of the top and bottom members has integral frame portions 55 that extend perpendicular to the plane of the main body portion 50. At the front of the locker, each of the top and bottom members has an integral front frame portion that includes (i) a proximal front frame portion 56 which extends perpendicular to the plane of the main body portion 50, and (ii) a distal front frame portion 58 which extends away from the proximal front frame portion 56 and toward the back of the locker. The distal front frame portion 58 is disposed in a horizontal plane that is parallel to the plane of the main body portion 50.

The proximal front frame portion 56 of each of the top and bottom members 16, 18 has pairs of bolt holes 60 which can align with the pairs of bolt holes 42 in the proximal front frame portions 32 of the side members 12. Each of the top and bottom members has a circular hole 61 in its main body portion 50 (FIG. 10) and an aligned circular hole 62 in its distal front frame portion 58 (FIG. 5). The circular hole 62 in the distal front frame portion 58 of the top member, and the aligned circular hole 61 in the main body portion 50 of the bottom member receive pivot members that pivotally connect the door 19 to the frame, as described more fully hereinafter. Finally, each of the top and bottom sheet metal members has rectangular slots 63 in its main body portion 50 (FIG. 6), and aligned rectangular slots 64 in its distal front frame portion 58 (FIG. 5). The rectangular slots 63 in the main body portion 50 of the bottom member, and the rectangular slots 64 in the distal front frame portion 58 of the top member receive the tenons 38 which extend from the distal front frame portions 34 on the side members 12.

In assembling the sheet metal members to form the locker, the tenons 38 on the distal front frame portions 34 of the side members 12 are inserted into the rectangular slots 63 in the main body portion 50 of the bottom member 18 and into the rectangular slots 64 in the distal front frame portion 58 of the top member 16. That engages and aligns the sheet metal side members 12 with the sheet metal top and bottom members 16, 18, and properly spaces the sheet metal side members 12 from each other. The pairs of bolt holes 60 in the proximal front frame portions 56 of the top and bottom members will align with the pairs of bolt 42 holes in the proximal frame portions 32 of the side members 12. The sheet metal side members 12 can thus be bolted to the sheet metal top and bottom members.

The back member 14 is positioned against the vertical frame portions 36 at the rear of the side members 12. The bolt holes 46 in the back member 14 are designed to align with the bolt holes 44 on the vertical rear frame portions 36 of the side members 12. Thus, the back member 14 can be bolted to the side member 12.

The frame portions 55 on the top and bottom members have bolt holes 67 (FIG. 3) which are designed to align with bolt holes 47 that extend horizontally along the side members 12, and with certain of the bolt holes 44 in the rear frame portions 36 of the side members. Thus, the top and bottom members can be further bolted to the side members 12 and the back member 14.

Bolting the side, top, bottom and back members to each other, in the manner set forth above, completes the locker's basic enclosure and also its frame. The proximal and distal front frame portions 32, 34 of the side members extend vertically along the door opening 17 and the proximal front frame portions 32, which are co-planar, also define part of the front side of the locker.

The proximal and distal front frame portions 56, 58 on the top member 16 extend horizontally along the door opening 17, and the proximal front frame portion 56, which is co-planar with the proximal front frame portions 32 of the side members 12, also defines part of the front side of the locker. With this construction, the frame portions that are integral with the sheet metal members interconnect those members, and provide strength and rigidity to the locker. The frame portions also form part of the front side of the locker and define the door opening 17 therein.

Figure 12:
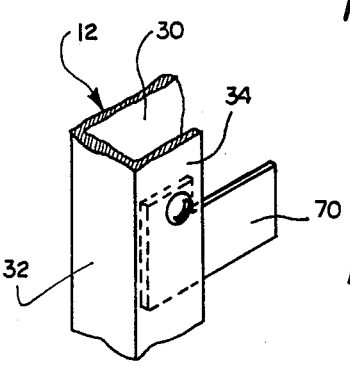
FIG. 12 is a fragmentary, three dimensional view of a portion of a locker, with the door removed, and showing structure for supporting part of a shelf in the locker.

When a shelf 69 (FIG. 3) is to be inserted in the locker, the shelf has depending flanges with bolt holes 71 which can align with the bolt holes 39 in side members 12 and with other bolt holes (not shown) in the back member 14, to allow the shelf 69 to be bolted to the back and side members. Additionally, the distal frame portions 34 of the side members 12 can have additional bolt holes, and metal clips 70 (FIG. 12) can be bolted thereto, for supporting the front end of the shelf. The bolt holes for the metal clips 70 are designed to be at the same vertical level as the vertical bolt holes 46, 44 along the back member 14, and the vertical rear frame portions 36 of the side members 12, respectively. The parts of the metal clips 70 that extend away from distal frame portions 34 of the side members are below the bolt holes in the front frame portions 34. Thus, the depending flange at the front of the shelf 69 can rest on the clips 70.

One or more plastic door stop members 72 is connected to the distal front frame portion 34 of the side member 12 that is shown in FIG. 6. The door stop member 72 preferably has a square stop portion 74 that protrudes out of the distal front frame portion 34, and a square neck portion 76 that is inserted in the square hole 37 in the distal front frame portion 34. A bolt 78 and nut (not shown) secure the door stop member 72 to the distal front frame portion 34.

Figure 10:
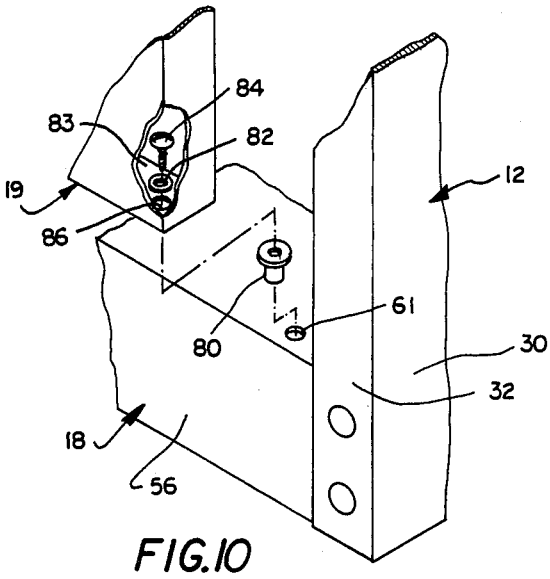
FIG. 10 is an exploded, fragmentary view of one of the lower corners of the locker door and the locker frame, showing the components for pivotally connecting the door to the locker frame.
Figure 11:
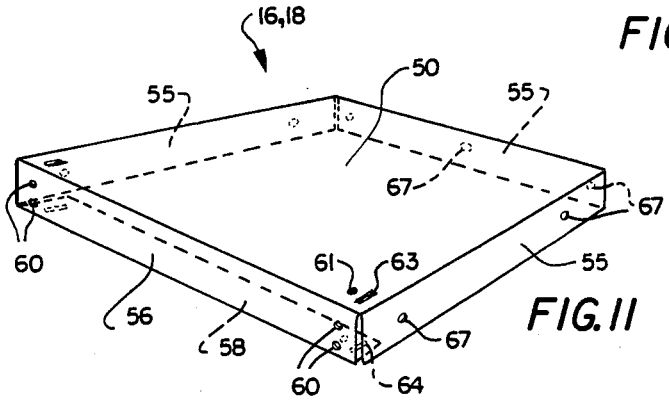
FIG. 11 is a three dimensional view of a sheet metal member forming each of the top and bottom members of the locker of the invention.

Referring now to FIGS. 5 and 10, the locker has a simple and efficient structure for pivotally connecting the door 19 to each of the top and bottom sheet metal members 16, 18. That structure comprises a pivotal, internally threaded hinge pin 80, a lock washer 82, and a standard screw 84. The hinge pins 80 have respective cylindrical surfaces that are rotatably received in the circular opening 61 in the main body portion 50 of the bottom member 18 and the aligned circular opening 62 in the distal frame portion 58 of the top member 16, respectively. At both its top and bottom ends, the door 19 has a horizontal flange 83, and the screw 84 extends through a hole 86 in the horizontal flange 83. The lock washer 82 is disposed between the screw's head and the door flange 83. At each end of the door, the screw 84 is screwed into the respective internally threaded hinge pin 80, as depicted in FIGS. 5 and 10, to engage the hinge pin with the door 19, and to pivotally connect the door 19 with the frame for pivotal movement about a vertical axis.

In the locker shown in FIG. 1, the pivot axis is adjacent the right hand side of the door. The side of the door opposite the pivot axis, and the side member 12 which is adjacent to that side of the door, have respective portions of a unique clip and handle structure. A pair of metal clips 90, 92 are connected with the door and the side member, respectively. The clips 90, 92 have aligned holes **90*c*, 92*c*** through which a padlock (not shown) can be inserted to securely lock the door to the frame of the locker.

The clip 90 includes a planar metal body member **90*a*, and a curved flange 90*b* at its distal end. The planar metal body member 90 lies adjacent the distal frame portion 34 of the one side member 12, and extends through the rectangular slot 40 in the proximal frame portion 32 of that side member. The planar metal body member 92*a* includes a locking hole 90*c* which is along the center line of the clip, i.e., equidistantly spaced between the top and bottom edges of the clip. The metal body member 90*a* also includes a bolt hole 90*d*, which is offset with respect to the center line of the clip. The bolt hole 90*d* is designed to align with one of the openings 35 in the side member 12, for receipt of a locking bolt 94 that fixedly connects the clip 90 to the side member 12 (FIG. 6**).

Figure 8:
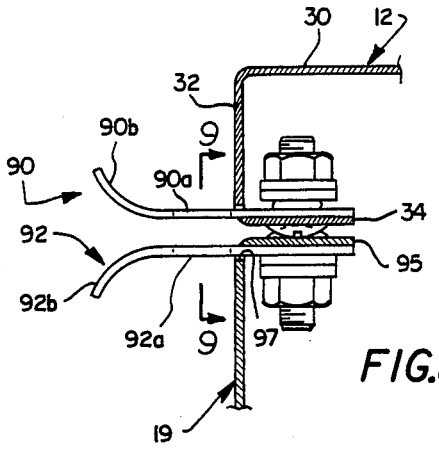
FIG. 8 is a fragmentary, sectional view of the clip portions carried by the locker's frame and door.
Figure 9:
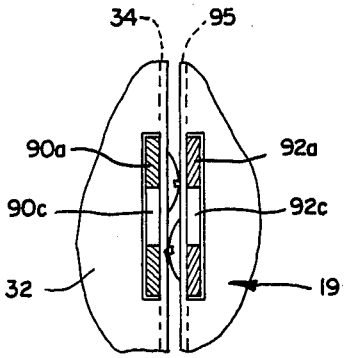
FIG. 9 is a sectional view of FIG. 8, taken along the line 9—9.

The clip 92 is structurally identical to the clip 90. It is inverted, with respect to the clip 90, so that its main body portion **92*a* can be bolted to a vertical flange 95 (FIG. 8) on the door 19, and extends through a slot 97 in the front of the door. Its locking hole 92*c* is aligned with the locking hole 90*c* in the other clip 90, so that a padlock can be inserted through the locking holes 90*c*, 92*c*, in the two clips to lock the locker. Since the clips 90, 92 are structurally identical, the bolt hole 92*d* on the clip 92 will be offset from the bolt hole 90*d* on the other clip 90. Thus, when the clips 90, 92 are bolted to the side member 12 and door 19, respectively, the bolts do not interfere with each other (see FIGS. 8 and 9). Also, the curved portion 92*b* at the distal end the clip 92 extends away from the curved portion 90*b* of the other clip 90, and forms a finger hook that can be readily engaged by a person's finger to open the locker door. Thus, the clip 92** also constitutes a handle for opening the door.

Figure 7:
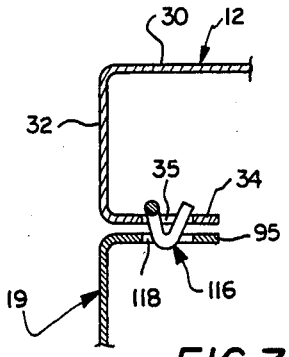
FIG. 7 is a fragmentary, sectional view of the locker of FIG. 1, with portions omitted, and showing the locking action provided by the spring clip.

A spring clip 110 is connected to the side member 12 on the other side of the door from the pivot axis (i.e., the side member 12 shown in FIG. 6). The spring slip 110 is designed to have a snap engagement with a mating hole in the door 19 to hold the door in a closed position. The spring clip 110 comprises a spring wire 112 whose configuration is shown in FIG. 6. The spring wire 112 is bent into a circular portion 114 defining an opening which can align with the same opening 35 in the side member 12 that the clip 90 is bolted to. A hex nut 99, a lock washer 101, and a flat washer 103 are provided, and the spring wire is attached to the side member 12 by the same locking bolt 94 that bolts the clip 90 to the side member 12. The spring wire 110 has a wedge-shaped portion 116 that extends through the other opening 35 in the distal frame portion 34 of the side member (FIG. 7). The wedge shaped portion 116 is dimensioned so that it can engage an opening 118 in the vertical flange 95 on the door 19 (FIG. 7) when the door is closed.

When the door 19 is being closed, the wedge shaped portion 116 of the spring wire 112 is initially cammed by the vertical flange 95 of the door 19, so that it moves out of the path of movement of the door. The wedge-shaped portion 116 then snaps into the opening 118 in the door 19, when the door is fully closed. The wedge shaped portion 116 is also cammed when the locker door is being opened, to release it from the opening 118 in the door. This provides a light holding action between the frame and the locker door 19 when the door is closed, but allows the locker door to be readily opened when desired.

As can be seen from the foregoing discussion, the locker of the invention is formed with relatively few parts that are simple to construct. The parts are readily assembled with each other, and are so designed that they can be shipped either in bulk or in an unassembled condition for subsequent assembly at the place where they are installed. Further, several significant pairs of components (i.e., the top and bottom members 16, 18 and the clips 90, 92) are formed by identical structural members. Thus, only a single type of forming operation is necessary to form both of the components. Moreover, the side members 12 are almost identical to each other except for (i) the presence of holes 35 and rectangular slot 40 in one side member, and (ii) the fact that the bolt holes 39, 41 in facing side members need to be mirror images of each other. Thus, all of the side members can be blanked by common tooling, and (i) one set of side members can be punched with an additional subdie for the bolt holes 35 and the rectangular slot 40, and (ii) punches for the bolt holes 39, 41 can be pulled and interchanged to punch those holes in both side members 12.

What is claimed is:

1. A vertically extending locker comprising a pair of spaced apart vertically extending sheet metal side members, a vertically extending sheet metal back member, a horizontally extending sheet metal top member, and a horizontally extending sheet metal bottom member, said locker having a front side with a door opening therein and a door which is mounted for movement between open and closed positions relative to said door opening to control access to the inside of the locker, said locker having a frame formed by said sheet metal members, each of said vertically extending sheet metal side members including a planar main body portion and a side frame portion integrally formed therefrom that extends out of the plane of the planar main body portion of the side member, said side frame portion of each of said sheet metal side members comprising a vertically extending proximal frame portion that extends perpendicular to the main body portion of the side member and a vertically extending distal frame portion that extends from said proximal frame portion toward the back of the locker and in a plane that is parallel to the plane of the main body portion of the side member, said horizontally extending sheet metal top and bottom members each including a planar main body portion and a frame portion integrally formed therefrom that extends out of the plane of said planar main body portion, said top and bottom frame portions each comprising a horizontally extending proximal frame portion that extends perpendicular to its associated main body portion and a horizontally extending distal frame portion that extends from its associated proximal frame portion toward the back of the locker and in a plane that is parallel to the plane of its associated main body portion, the proximal frame portion of both said sheet metal top and bottom members being bolted to the proximal side frame portions of both of said sheet metal side members for interconnecting the sheet metal top and bottom members with said sheet metal side members, the distal frame portion of each sheet metal side member including locking tenons integrally formed therefrom at its upper and lower ends, the distal frame portion of said sheet metal top member and the main body portion of said sheet metal bottom member including slots for receiving the locking tenons on the distal frame portions of said sheet metal side members to help engage the sheet metal side members with the sheet metal top and bottom members, the proximal side frame portions of said side members and the proximal top and bottom frame portions being coplanar and defining part of the front side of the locker, the proximal and distal frame portions of said side members and the proximal and distal frame portions of said top member cooperating with said bottom member to define the door opening.

2. A locker as set forth in claim 1 wherein said door and one of said sheet metal side members have respective clip portions attached thereto, said clip portions extending outwardly of the front side of the locker and having aligned locking holes for receiving a padlock or other locking member, said clip portions having distal ends which curve away from each other, the curved distal end of the clip portion attached to said door defining a finger handle which is engageable by a person's finger to open the door.

3. A locker as set forth in claim 2 wherein said clip portions are structurally identical to each other.

4. A locker as set forth in claim 1 including means connecting said door for pivoting movement relative to said door opening, said means comprising a pair of aligned hinge pins connected with the top and bottom of the door respectively, the hinge pins having respective internally threaded cylindrical shafts extending vertically upward and downward from the top and bottom of the door respectively, each hinge pin being fixedly connected to the door by means of a screw that engages part of the door and also engages the internal threads in the hinge pin, the cylindrical shaft extending upwardly from the top of the door being pivotally received in a circular opening in the distal frame portion of the top member, and the cylindrical shaft extending downwardly from the bottom of the door being pivotally received in an aligned circular opening in the main body portion of said bottom member.

5. A locker as defined in claim 1 comprising a latch connected with said frame and engageable with said door when said door is pivoted to said closed position for maintaining said door in said closed position, said latch comprising a spring wire member fixedly connected with said distal frame portion of one of said side members, said spring wire member having a portion configured to define a wedge shaped locking portion biased toward a position extending outwardly from said distal frame portion and into the path of movement of a portion of said door as said door pivots from an open position to a closed position, said portion of said door including a recess therein, said recess having a first surface which engages said wedge shaped locking portion and urges it out of said path of movement of said portion of said door as said door moves to said closed position, said recess providing a space into which said wedge shaped portion can snap and having a second surface which along with said first surface retains the wedge shaped portion in said space when said door is in said closed position, said second surface engaging said wedge shaped portion and urging it out of said path of movement of said portion of said door as said door is moved to said open position.

6. A locker as set forth in claim 5 wherein the distal frame portion of said one side member comprises a door stop connected thereto, for limiting the range of pivoting motion of the door as it is moved to a closed position.

7. A locker as set forth in claim 1 wherein the distal frame portions of each side member has a shelf support member connected thereto and disposed for engaging the underside of a shelf disposed in the locker.

8. A locker as set forth in claim 1 wherein said sheet metal top and bottom members are structurally identical to each other.

9. Apparatus for forming a locker, said apparatus comprising a pair of sheet metal side members, a sheet metal back member, a sheet metal top member, and a sheet metal bottom member, said sheet metal members being connectable with each other to define the locker's enclosure, said sheet metal side members including a planar main body portion and a side frame portion integrally formed therefrom that extends out of the plane of the planar main body portion of the side member, said side frame portion of each of said sheet metal side members including a proximal frame portion that extends perpendicular to the main body portion of the side member and a distal frame portion that extends from said proximal frame portion in a plane that is parallel to the plane of the main body portion of the side member, said sheet metal top and bottom members each including a planar main body portion and a frame portion integrally formed therefrom that extends out of the plane of its associated planar main body portion, each of said top and bottom frame portions comprising a proximal frame portion that extends perpendicular to its associated main body portion and a distal frame portion that extends from its associated proximal frame portion in a plane that is parallel to the plane of its associated main body portion, the proximal frame portions of said sheet metal top and bottom members each being connectable to the proximal side frame portions of both of said sheet metal side members, the distal side frame portion of each side member extends longitudinally and includes locking tenons at each of its longitudinal ends, the distal frame portion of said sheet metal top member and the main body portion of said sheet metal bottom member including respective slots for receiving the locking tenons to help engage the sheet metal side members with the sheet metal top and bottom members, said top and bottom frame portions and said side frame portions of both sheet metal side members including respective portions to form the front side of the locker and a door opening.

10. Apparatus as set forth in claim 9 comprising respective clip portions for said door and one of said sheet metal side members, each said clip portions including a main body portion and respective aligned locking holes for receiving a locking member, each said clip portions including a distal curved end defining a finger handle.

11. Apparatus as set forth in claim 10 wherein said clip portions are structurally identical to each other.

12. Apparatus as set forth in claim 9 including means for connecting said door for pivoting movement relative to said door opening, said means comprising a pair of hinge pins for connection with the top and bottom of the door respectively, the hinge pins having respective internally threaded cylindrical shafts designed to extend outwardly from the top and bottom of the door when the hinge pins are connected with the door, means for fixedly connecting each hinge pin to the door comprising a screw for engaging part of the door and also engaging the internal threads in the hinge pin, the proximal frame portion of the top member having a circular opening for pivotally receiving one of the hinge pins, the main body portion of said bottom member having a circular opening for receiving the other hinge pin.

13. Apparatus as defined in claim 9 further including a spring wire latch member connectable with said distal frame portion of one of said side members, said spring wire latch member having a portion configured to define a wedge shaped locking portion for engaging a mating recess in the door, said distal frame having an opening through which said wedge shaped locking portion can protrude in order to engage the mating recess in the door.

14. Apparatus as set forth in claim 9 wherein said bottom sheet metal member is structurally identical to said top sheet metal member.

* * * * *